US009141067B2

(12) United States Patent
Serizawa

(10) Patent No.: US 9,141,067 B2
(45) Date of Patent: Sep. 22, 2015

(54) IMAGE FORMING APPARATUS THAT IS CAPABLE OF DOUBLE-SIDED PRINTING, CONTROL METHOD THEREFOR, AND STORAGE MEDIUM STORING CONTROL PROGRAM THEREFOR

(71) Applicant: CANON KABUSHIKI KAISHA, Tokyo (JP)

(72) Inventor: Masahiro Serizawa, Abiko (JP)

(73) Assignee: CANON KABUSHIKI KAISHA (JP)

( * ) Notice: Subject to any disclaimer, the term of this patent is extended or adjusted under 35 U.S.C. 154(b) by 157 days.

(21) Appl. No.: 13/874,719

(22) Filed: May 1, 2013

(65) Prior Publication Data

US 2013/0302045 A1 Nov. 14, 2013

(30) Foreign Application Priority Data

May 9, 2012 (JP) ..... 2012-107466

(51) Int. Cl.
*G03G 15/00* (2006.01)
*B65H 85/00* (2006.01)
*G03G 15/23* (2006.01)

(52) U.S. Cl.
CPC ..... *G03G 15/70* (2013.01); *G03G 15/231* (2013.01)

(58) Field of Classification Search
CPC ..... G03G 15/00; G03G 15/70; G03G 15/231; B65H 85/00
USPC ..... 399/361, 364, 381, 401, 402, 21
See application file for complete search history.

(56) References Cited

U.S. PATENT DOCUMENTS

| | | | | | |
|---|---|---|---|---|---|
| 5,258,818 | A * | 11/1993 | Sundquist et al. | ..... | 399/19 |
| 5,499,091 | A * | 3/1996 | Kasiwabara et al. | ..... | 399/364 |
| 8,302,963 | B2 * | 11/2012 | Ban | ..... | 271/258.02 |
| 8,380,090 | B2 * | 2/2013 | Hanayama | ..... | 399/19 |
| 2015/0049356 | A1 * | 2/2015 | Saitsu | ..... | 358/1.14 |

FOREIGN PATENT DOCUMENTS

| | | | | | |
|---|---|---|---|---|---|
| JP | 01114862 | A * | 5/1989 | ..... | G03G 15/00 |
| JP | 09236957 | A * | 9/1997 | ..... | G03G 15/00 |
| JP | 11-249506 | | 9/1999 | | |
| JP | 2013235137 | A * | 11/2013 | ..... | G03G 15/00 |

* cited by examiner

*Primary Examiner* — Nguyen Ha
(74) *Attorney, Agent, or Firm* — Rossi, Kimms & McDowell LLP

(57) ABSTRACT

An image forming apparatus that is capable of using a residual sheet effectively even in a double-sided printing mode. A control unit controls to perform a double-sided image formation process to recording sheets. A detection unit detects a jam of the recording sheet. A determination unit determines whether residual sheets, which are recording sheets on the conveyance path other than a jamming sheet that generates a jam, are available in the image forming process resumed after the jam is removed based on the number of copies of sheets on which the same image is formed, the recording sheets on which images have been formed on one sides, and the latest recording sheet that was normally ejected. The control unit stops the process and ejects the residual sheets that are determined unavailable from the conveyance path when a jam is detected during the process.

17 Claims, 8 Drawing Sheets

IMAGE FORMING APPARATUS THAT IS CAPABLE OF DOUBLE-SIDED PRINTING, CONTROL METHOD THEREFOR, AND STORAGE MEDIUM STORING CONTROL PROGRAM THEREFOR

BACKGROUND OF THE INVENTION

1. Field of the Invention

The present invention relates to an image processing apparatus that has a function for forming images on both sides of a sheet, a control method therefor, and a storage medium storing control program therefor.

2. Description of the Related Art

An image forming apparatus is controlled so that an image forming operation and a sheet conveying operation are stopped when a paper jam (referred to as "a jam", hereafter) occurs during conveyance of a recording sheet, and so that a subsequent operation does not start until a recording sheet on a conveyance path will be removed.

A plurality of recording sheets may stay on the conveyance path in the apparatus besides the recording sheet (jamming sheet) that is determined as a cause of jam at a jam occurrence point. The conveying operation and the image forming operation may be continued for a recording sheet that is nearer to an ejection port on the conveyance path (i.e., a downstream sheet) than the jamming sheet, and the downstream sheet can be ejected as-is.

However, conveyance of a recording sheet located in the upstream direction on the conveyance path from the jamming sheet stops like the jamming sheet.

A recording sheet (a residual sheet) that is remained on the conveyance path and is not a jamming sheet is likely not to be damaged unlike a jamming sheet. Accordingly, it is preferable to leave the residual sheet inside the apparatus and to re-convey the sheet after removing the jamming sheet to use without removing or discarding the residual sheet by a user.

Since such a use of a residual sheet saves user's time and trouble, and eliminates the need for discarding a recording sheet, it becomes a user's merit.

For example, Japanese Laid-Open Patent Publication (Kokai) No. H11-249506 (JP H11-249506) discloses an apparatus that does not remove a recording sheet located in the upper stream than a registration roller and that tries to use the recording sheet after a jam removal operation is finished.

However, since the conventional technique is premised on the case where an image is formed on one side of a recording sheet, it may not restart the image forming operation using a residual sheet when a jam occurs during an operation in a double-side mode that forms images on both sides of a recording sheet.

This is because an output product does not necessarily achieve a correct page order of recording sheets including a residual sheet when a recording sheet on which an image has been formed on a first side remains on a double-sided path as the residual sheet.

Timing of jam occurrence determines whether the residual sheet can be used or not. That is, there are two cases when the apparatus stops due to a jam and a residual sheet on which an image is formed on one side (front face) remains in a double-sided path. In one case, the residual sheet is able to be used after the jam is removed. In the other case, the residual sheet is not able to be used even after the jam is removed. This is a problem.

SUMMARY OF THE INVENTION

The present invention provides an image forming apparatus, a control method therefor, and a storage medium storing a control program therefor, which are capable of using a residual sheet effectively even in an operation in a double-sided printing mode.

Accordingly, a first aspect of the present invention provides an image forming apparatus comprising a conveyance unit configured to convey a recording sheet along a conveyance path, an image forming unit configured to form an image on the recording sheet conveyed by the conveyance unit, a control unit configured to control the conveyance unit and the image forming unit so that a double-sided image formation process is performed to a plurality of recording sheets, a detection unit configured to detect a jam of the recording sheet on the conveyance path, and a determination unit configured to determine whether residual sheets, which are recording sheets on the conveyance path other than a jamming sheet that generates a jam, are available in the image forming process resumed after the jam is removed when the jam is detected by the detection unit based on the number of copies of sheets on which the same image is formed, the recording sheets on which images have been formed on one sides, and the latest recording sheet that was normally ejected. The control unit stops the double-sided image formation process and ejects the residual sheets that are determined unavailable by the determination unit from the conveyance path when the detection unit detects a jam during the process.

Accordingly, a second aspect of the present invention provides a control method for an image forming apparatus that performs a double-sided image formation process to a plurality of recording sheets, the control method comprising a detection step of detecting a jam of a recording sheet on a conveyance path, a stopping step of stopping the double-sided image formation process when a jam is detected in the detection step, a determination step of determining whether residual sheets, which are recording sheets on the conveyance path other than a jamming sheet that generates a jam, are available in the image forming process resumed after the jam is removed when the jam is detected in the detection step based on the number of copies of sheets on which the same image is formed, the recording sheets on which images have been formed on one sides, and the latest recording sheet that was normally ejected, and an ejection step of ejecting the residual sheets determined unavailable in the determination step from the conveyance path.

Accordingly, a third aspect of the present invention provides a non-transitory computer-readable storage medium storing a control program causing a computer to execute the control method according to the second aspect.

The present invention is able to provide the image forming apparatus, the control method therefor, and the storage medium storing the control program therefor, which are capable of using a residual sheet effectively even in an operation in a double-sided printing mode.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
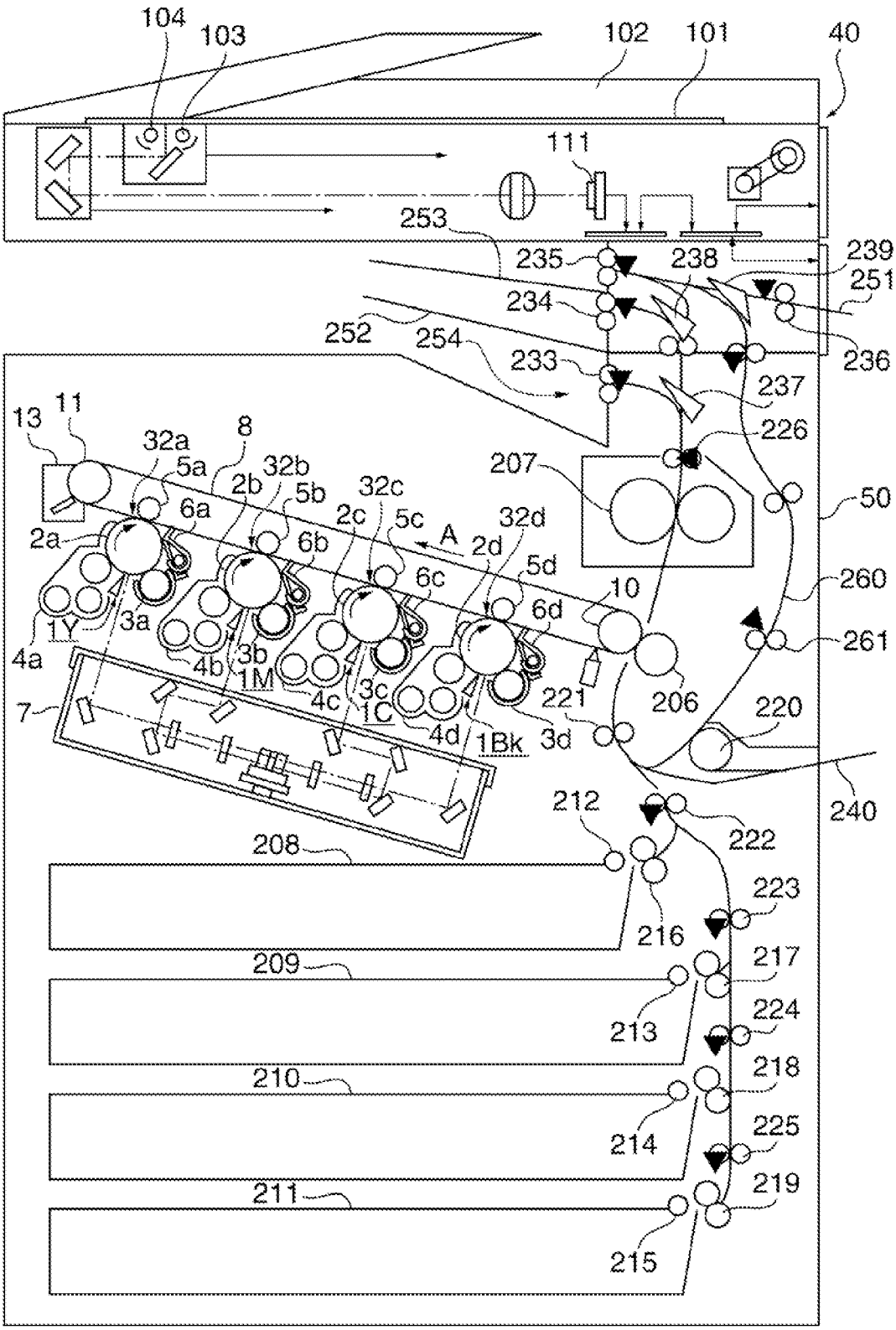
FIG. 1 is a view schematically showing a configuration of an image forming apparatus according to an embodiment of the present invention.

FIG. 1 is a view schematically showing a configuration of an image forming apparatus 30 according to an embodiment of the present invention.

As shown in FIG. 1, the image forming apparatus 30 mainly consists of a color reading unit 40 and a color printing unit 50.

First, the configuration of the color reading unit 40 will be described. The color reading unit 40 optically reads an image of an original laid on a contact glass 101, converts the read image into electronic data, and outputs it to a later stage.

An ADF (automatic document feeder) 102 conveys an original laid on the ADF 102 onto the contact glass 101 one by one.

The original is irradiated by light sources 103 and 104. A reflected light from the original surface forms an image on an image reading element 111. The original image is converted into electronic data when the image reading element 111 reads the reflected light from the original surface.

The image data outputted from the image reading element 111 is sent to a reader control board (reader control unit) 113 on which a CPU for controlling the entire color reading unit 40, an image memory for storing image data, and the like are mounted.

Next, a configuration of the color printing unit 50 will be described. The color printing unit 50 is provided with four image forming units including an image forming unit 1Y that forms a yellow image, an image forming unit 1M that forms a magenta image, an image forming unit 1C that forms a cyan image, and an image forming unit 1Bk that forms a black image. These four image forming units are arranged so that they are aligned at fixed intervals.

The image forming units 1Y, 1M, 1C, and 1Bk are provided with photosensitive drums 2*a*, 2*b*, 2*c*, and 2*d* as image bearing members, respectively.

Moreover, primary electrostatic chargers 3*a*, 3*b*, 3*c*, and 3*d*, development devices 4*a*, 4*b*, 4*c*, and 4*d*, transfer rollers 5*a*, 5*b*, 5*c*, and 5*d*, and drum cleaning devices 6*a*, 6*b*, 6*c*, and 6*d* are mounted around the photosensitive drums 2*a*, 2*b*, 2*c*, and 2*d*.

A laser exposure device 7 is arranged under the development devices 4*a*, 4*b* 4*c*, and 4*d*. The development devices 4*a*, 4*b*, 4*c*, and 4*d* contain yellow toner, magenta toner, cyan toner, and black toner, respectively.

The photosensitive drums 2*a*, 2*b*, 2*c*, and 2*d* are driven so as to rotate at predetermined process speed in an arrow direction (the clockwise direction in FIG. 1) by a drive unit (not shown).

The primary electrostatic chargers 3*a*, 3*b*, 3*c*, and 3*d* uniformly charge the surfaces of the photosensitive drums 2*a*, 2*b*, 2*c*, and 2*d* with charging bias applied from a charging bias power supply (not shown) in a predetermined potential in the negative polarity, respectively.

Electrostatic latent images formed on the photosensitive drums 2*a*, 2*b*, 2*c*, and 2*d* by the laser exposure device 7 are developed by applying the toner of the respective colors to form toner images (visualization).

The laser exposure device 7 consists of a laser generator for emitting light in response to sequential digital pixel signals of given image data, a polygon mirror, an fθ lens, reflective mirrors, etc.

In primary transfer unit 32*a*, 32*b*, 32*c*, and 32*d*, the transfer rollers 5*a*, 5*b*, 5*c*, and 5*d* are arranged so as to be possible to contact with the photosensitive drums 2*a*, 2*b*, 2*c*, and 2*d* through an intermediate-transfer belt 8, respectively.

The drum cleaning devices 6*a*, 6*b*, 6*c*, and 6*d* remove excess toner that remained on the photosensitive drums 2*a*, 2*b*, 2*c*, and 2*d* on the occasion of primarily transferring from the photosensitive drums 2*a*, 2*b*, 2*c*, and 2*d*.

The intermediate transfer belt 8 loops between a secondary transfer roller 10 and a tension roller 11 over the photosensitive drums 2*a*, 2*b*, 2*c*, and 2*d*, and rotates in an arrow direction A (a counterclockwise direction in FIG. 1).

A belt cleaning device 13 is arranged near the tension roller 11 so as to face the intermediate transfer belt 8. The belt cleaning device 13 removes and collects excess toner that remained on the surface of the intermediate transfer belt 8 after secondary transferring.

The recording sheet on which the toner image was transferred at the secondary transfer position is conveyed to a fixing device 207 that is arranged above the secondary transfer position as a vertical pass configuration, the toner image is fixed by a fixing roller and a pressure roller.

The image forming operation performed by the image forming apparatus 30 shown in FIG. 1 will be described.

In response to an image-formation-start signal, the photosensitive drums 2*a*, 2*b*, 2*c*, and 2*d* of the image forming units 1Y, 1M, 1C, and 1Bk rotate at the predetermined process speed.

Then, the photosensitive drums 2*a*, 2*b*, 2*c*, and 2*d* are uniformly electrified in negative polarity by the primary electrostatic chargers 3*a*, 3*b*, 3*c*, and 3*d*, respectively. Then, the laser exposure device 7 outputs laser beams by the laser generator in synchronization with the image signal.

The outputted laser beams irradiate the respective photosensitive drums 2*a*, 2*b*, 2*c*, and 2*d* via the polygon mirror, the fθ lens, the reflective mirrors, etc., and the electrostatic latent images of the respective colors are formed on the photosensitive drums 2*a*, 2*b*, 2*c*, and 2*d*.

Next, the development device 4*a* to which the electrified polarity (negative polarity) that is identical to the polarity of the photosensitive drum 2*a* is impressed applies yellow toner to the electrostatic latent image formed on the photosensitive drum 2*a* to visualize yellow toner image.

The visualized yellow toner image is transferred onto the rotating intermediate transfer belt 8 by the transfer roller 5*a* to which the primary transfer bias (positive polarity opposite to the polarity of toner) is impressed in the primary transfer unit 32*a* between the photosensitive drum 2*a* and the transfer roller 5*a* (primarily transferring).

The intermediate transfer belt 8 continues to rotate thereafter, and the part on the intermediate transfer belt 8 to which the yellow toner image was transferred comes to the image forming unit 1M.

In the image forming unit 1M, the electrostatic latent image formed on the photosensitive drum 2*b* is visualized as a magenta toner image with the magenta toner in the same manner as the visualization of the yellow toner image in the image forming unit 1Y, and the magenta toner image is transferred onto the intermediate transfer belt 8 in the primary transfer unit 32*b* so that the magenta toner image overlaps the yellow toner image.

In the same manner, a cyan toner image and a black toner image are transferred onto the intermediate transfer belt 8 in the primary transfer units 32*c* and 32*d*, respectively, so that all the toner images overlap. As a result, a full color toner image is formed on the intermediate transfer belt 8.

On the other hand, a recording sheet is picked up from one of a first cassette 208, a second cassette 209, a third cassette 210, and a fourth cassette 211 by the corresponding pickup roller 212, 213, 214, or 215.

Then, the sheet is fed by one of feed rollers 216, 217, 218, and 219 of the respective cassettes, and is conveyed to a registration roller 221 by a vertical-path conveying roller 222, and vertical-path conveying rollers 223, 224, and 225 if needed.

In the case of manual feeding, one recording sheet is separated from a sheet bundle loaded on a manual bypass tray 240 by a manual feed roller 220, and the recording sheet is conveyed to the registration roller 221 as-is.

The registration roller 221 starts to convey the recording sheet in synchronization with the timing at which the transferring to the intermediate transfer belt 8 finishes so that the toner image on the intermediate transfer belt 8 is coincident with the recording sheet exactly at the position of a secondary transfer roller 206.

Then, while the recording sheet is conveyed toward the fixing device 207 by nipped between the secondary transfer roller 206 and the intermediate transfer belt 8, the recording sheet is pressed to the intermediate transfer belt 8 by the secondary transfer roller 206, and the toner image on the intermediate transfer belt 8 is transferred onto the recording sheet (secondary transferring).

Then, the recording sheet on which the toner image was transferred secondarily is conveyed to the fixing device 207, and the toner image is fixed to the recording sheet in the fixing device 207. A fixing sensor 226 detects conveyance of the recording sheet after fixing.

When a first ejection flapper 237 is directed to a first ejection roller 233, the recording sheet on which the toner image is fixed is guided to the first ejection roller 233, and is ejected from a first ejection port 254.

Moreover, when the first ejection flapper 237 and a second ejection flapper 238 are directed to a second ejecting roller 234, the recording sheet is guided to the second ejection roller 234, and is ejected from a second ejection port 252.

Moreover, when the first flapper 237 and the second ejection flapper 238 are directed to a reversal roller 235, the recording sheet is guided to the reversal roller 235. Then, the recording sheet is conveyed by the reversal roller 235 toward the outside of the image forming apparatus 30, and stops before the rear end of the recording sheet passes the reversal roller 235. When the rotating direction of the reversal roller 235 is reversed at the point, the recording sheet is conveyed toward a third ejection port 251 along a conveyance path. At this time, when a third ejection flapper 239 is directed to a third ejecting roller 236, the recording sheet is guided to the third ejecting roller 236, and is ejected from the third ejection port 251.

In the case of double-sided print, the recording sheet on which a toner image corresponding to a front side of an original was fixed on one side is conveyed to the reversal roller 235. The rotating direction of the reversal roller 235 is reversed after that, and the recording sheet is conveyed in the reverse direction. After that, the third ejection flapper 239 is directed to a double-sided path (a double-sided conveyance path) 260, and the recording sheet is conveyed to the double-sided path 260. The recording sheet conveyed along the double-sided path 260 is conveyed to the registration roller 221 by a double-sided feed roller 261, and a toner image corresponding to a back side of the original is transferred and fixed on the other side of the recording sheet. The recording sheet on which the image corresponding to the back side of the original was fixed is ejected from one of the first ejection port 254, the second ejection port 252, and the third ejection port 251 according to ejection setting.

A residual-sheet-ejection port 253 is used when a residual sheet is ejected by the reversal roller 235.

Figure 2A:
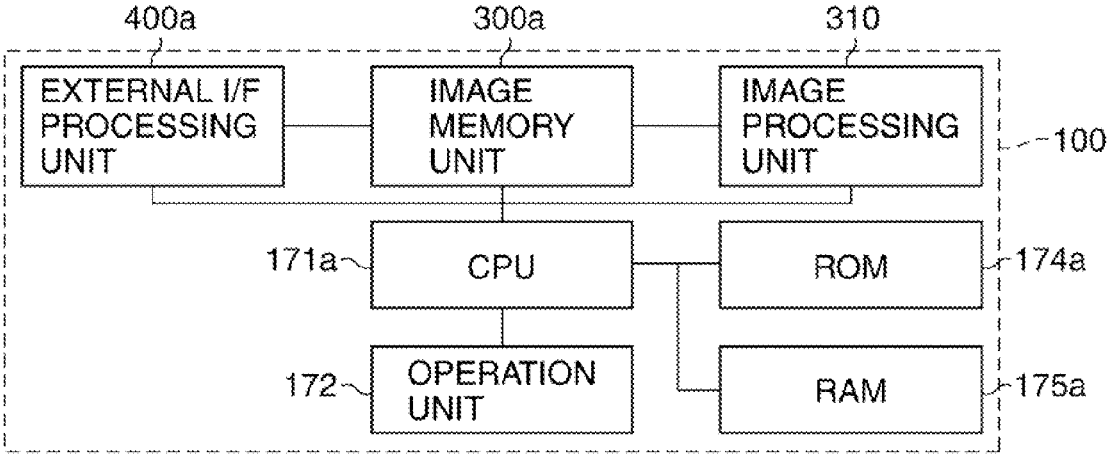
FIG. 2A is a block diagram schematically showing a configuration of the system control unit in FIG. 1.
Figure 2B:
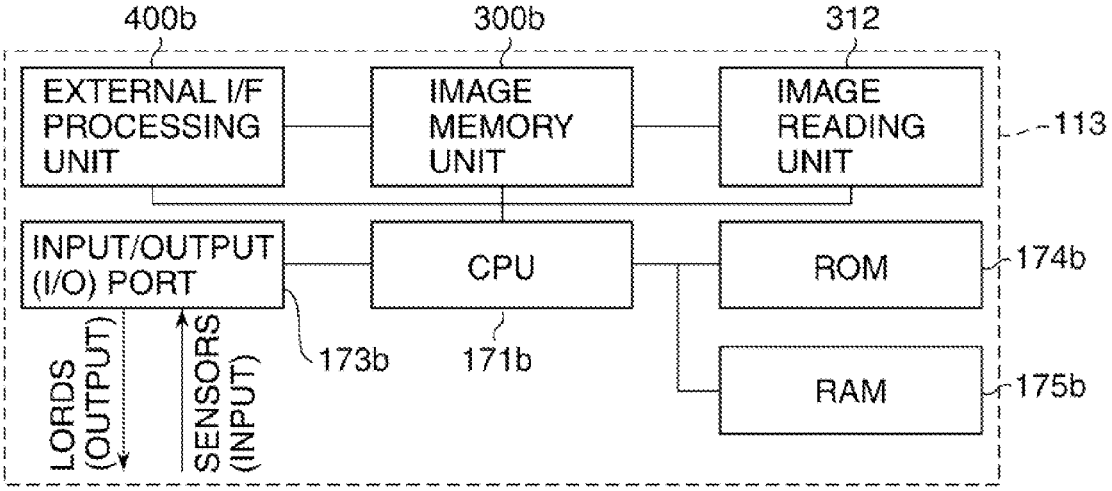
FIG. 2B is a block diagram schematically showing a configuration of the reader control unit in FIG. 1.
Figure 2C:
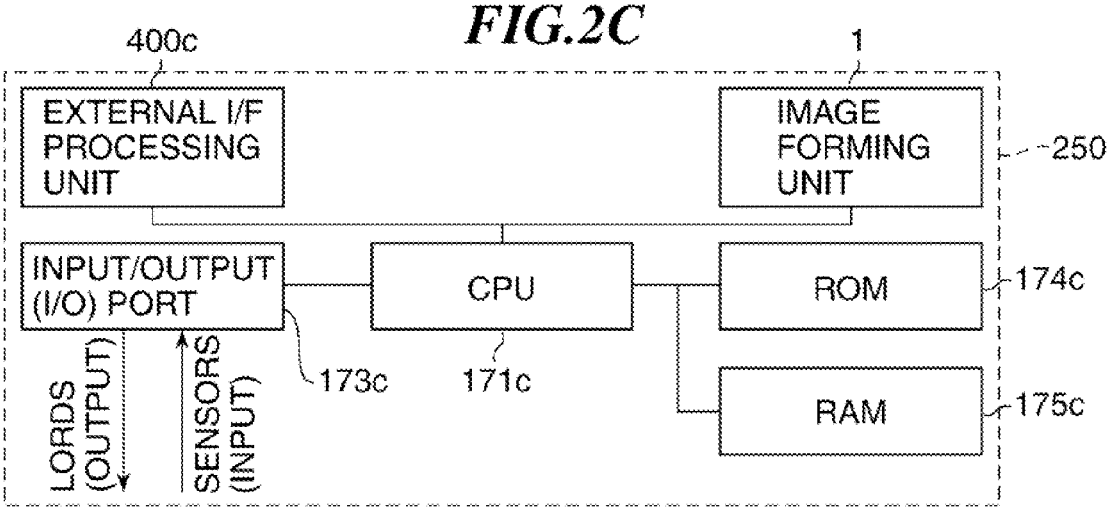
FIG. 2C is a block diagram schematically showing a configuration of the printer control unit in FIG. 1.

FIG. 2A through FIG. 2C are block diagrams showing configurations of respective control units of the image forming apparatus 30 shown in FIG. 1. FIG. 2A shows a configuration of a system control unit 100, FIG. 2B shows a configuration of a reader control unit 113, and FIG. 2C shows a configuration of a printer control unit 250.

The system control unit 100 controls operations of the entire image forming apparatus 30 by communicating states and commands with the reader control unit 113, the digital image processing unit (not shown), and the printer control unit 250. The printer control unit 250 controls print operations in response to instructions from the system control unit 100.

In more detail, the system control unit 100 acquires data of an original image by instructing execution of an image reading operation to the color reading unit 40, and once stores the acquired image data in the memory in the system control unit 100.

Then, the system control unit 100 executes the image forming operation by transmitting the image data in the memory to the printer control unit 250 as an image data signal in synchronization with a video clock according to reference timing from the printer control unit 250. The details of the system control unit 100, the reader control unit 113, and the printer control unit 250 will be described later.

As shown in FIG. 2A, the system control unit 100 includes a CPU 171*a*, an operation unit 172, a ROM 174*a*, a RAM 175*a*, an external I/F processing unit 400*a*, an image memory unit 300*a*, and the image processing unit 310, which are connected via a bus.

The CPU 171*a* controls the system control unit 100. Programs for the systems control and the like are stored in the ROM 174*a*. The RAM 175*a* is used as a work area at the time of execution of various processes by the CPU 171*a*.

The operation unit 172 includes a display unit that displays information for a user, a key input unit that a user operates, etc. A user can operate the key input unit for changing an image formation mode or changing the information displayed on the display unit. In response to such an operation, the CPU 171*a* displays the state of the image forming apparatus 30 on the display unit based on the state of the color reading unit 40 acquired from the reader control unit 113 and the state of the color printing unit 50 acquired from the printer control unit 250.

The external I/F processing unit 400*a* communicates with the reader control unit 113 to receive image data, or exchanges the image data and processing data with an external apparatus like a PC. Furthermore, the external I/F processing unit 400*a* communicates with the printer control unit 250 to transmit print data.

The image memory unit 300*a* stores image data. The image processing unit 310 applies image processes, such as a compression/extension process and a concentration tuning process, to the image data stored in the image memory unit 300*a*.

As shown in FIG. 2B, the reader control unit 113 includes a CPU 171*b*, a ROM 174*b*, a RAM 175*b*, an external I/F processing unit 400*b*, an image memory unit 300*b*, an input/output (I/O) port 173*b*, and an image reading unit 312, which are connected via a bus.

The CPU 171*a* controls the system control unit 113. Programs for controlling the reader and the like are stored in the ROM 174*b*. The RAM 175*b* is used as a work area at the time of execution of various processes by the CPU 171*b*.

Various loads, such as motors and clutches for controlling the operation of the image forming apparatus 30, and input devices, such as a sensor for detecting a position of an original, are connected to the input/output port 173*b*.

The image reading unit 312 reads an original image and generates image data. The image memory unit 300*b* is used for temporarily storing the image data generated by the image reading unit 312.

The external I/F processing unit 400*b* communicates with the system control unit 100, and transmits the image data stored in the image memory unit 300*b* to the system control unit 100.

As shown in FIG. 2C, the printer control unit 250 includes a CPU 171*c*, a ROM 174*c*, a RAM 175*c*, an external I/F processing unit 400*c*, an image forming unit 1, and an input/output (I/O) port 173*c*, which are connected via a bus.

The CPU 171*c* controls the printer control unit 250. Programs for controlling the printer and the like are stored in the ROM 174*c*. The RAM 175*c* is used as a work area at the time of execution of various processes by the CPU 171*c*.

Various loads, such as motors and clutches for controlling the operation of the image forming apparatus 30, and input devices, such as a sensor for detecting a position of a recording sheet, are connected to the input/output port 173*c*.

The external I/F processing unit 400*c* communicates with the system control unit 100 to receive print data.

The image forming unit 1, which collectively expresses the image forming units 1Y, 1M, 1C, and 1Bk shown in FIG. 1, drives the laser exposure device 7 based on the print data received in synchronization with the conveying operation of the recording sheet controlled through the input/output port 173*c*.

FIG. 3A through FIG. 3F are views showing motions of a recording sheet P on a conveyance path in the case of forming images on both sides of the recording sheet P.

In FIG. 3A through FIG. 3F, a long-dashed line shows the part of the recording sheet P on which no image is formed on both sides, a short-dashed line shows the part of the recording sheet P on which an image is formed on one side (a front side), and a thick solid line shows the part of the recording sheet P on which images are formed on both sides.

Figure 3A:
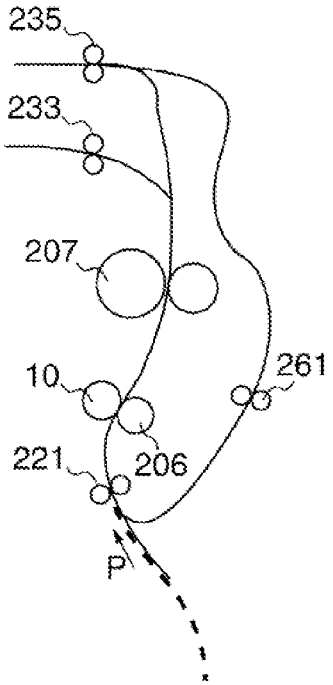
FIG. 3A through FIG. 3F are views showing motions of a recording sheet on a conveyance path in the case of forming images on both sides of the recording sheet in the image forming apparatus shown in FIG. 1.

FIG. 3A shows the recording sheet P that is supplied and reaches the registration roller 221. The recording sheet P is conveyed from the registration roller 221 so that the toner image transferred on the intermediate transfer belt 8 is transferred to the recording sheet P at the position of the secondary transfer roller 206.

Figure 3B:
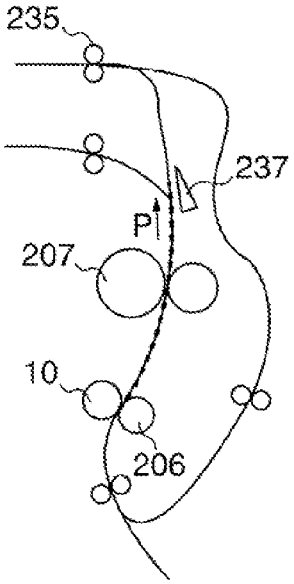

FIG. 3B shows the recording sheet P on which the image was transferred on the front side by the secondary transfer opposite roller 10 and the secondary transfer roller 206, and of which the half has been fixed by the fixing device 207. Since the first ejection flapper 237 is directed to the reversal roller 235, the recording sheet P is conveyed towards the reversal roller 235.

Figure 3C:
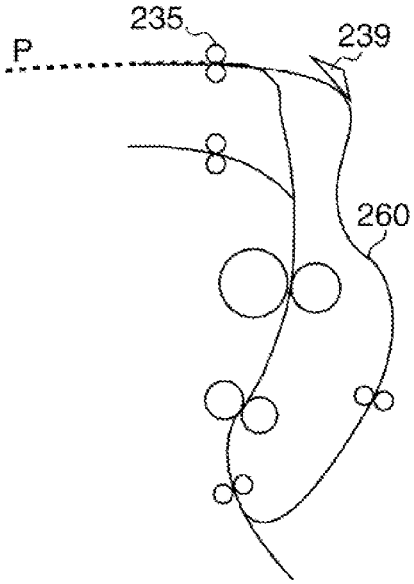

FIG. 3C shows the recording sheet P that is stopped by nipping with the reversal roller 235. Then, the recording sheet P is conveyed to the double-sided path 260 by changing the direction of the third ejection flapper 239 to the double-sided path 260 and reversing the rotating direction of the reversal roller 235.

Figure 3D:
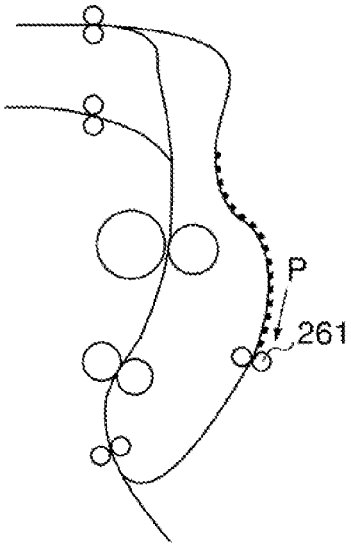

FIG. 3D shows the recording sheet P that was conveyed to the double-sided path 260 and arrived at the double-sided feed roller 261.

Figure 3E:
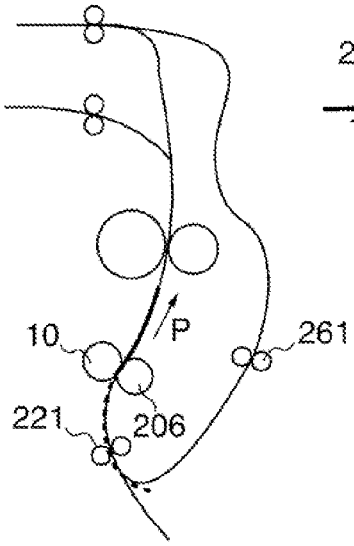

FIG. 3E shows the recording sheet P that was fed by the double-sided feed roller 261 again and is an object to which an image is being transferred to the back side while being conveyed by the registration roller 221.

Figure 3F:
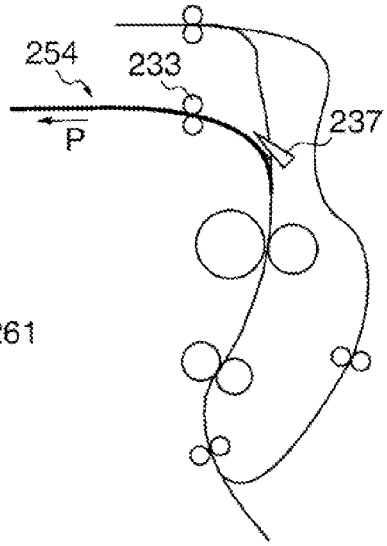

FIG. 3F shows the recording sheet P to which the images were formed on both sides and that is ejected from the first ejection port 254 by the first ejection flapper 237 and the first ejection roller 233.

Although FIG. 3A through FIG. 3F show the motions of one recording sheet, the fundamental motions are common to the case where a plurality of recording sheets are conveyed. However, the conveyance of sheets is controlled so that an image formation to a front side of sheet that is fed from a cassette (a first feeding unit) and an image formation to a back side of sheet that is fed through the double-sided path 260 (a second feeding unit) are performed alternately.

Figure 4:
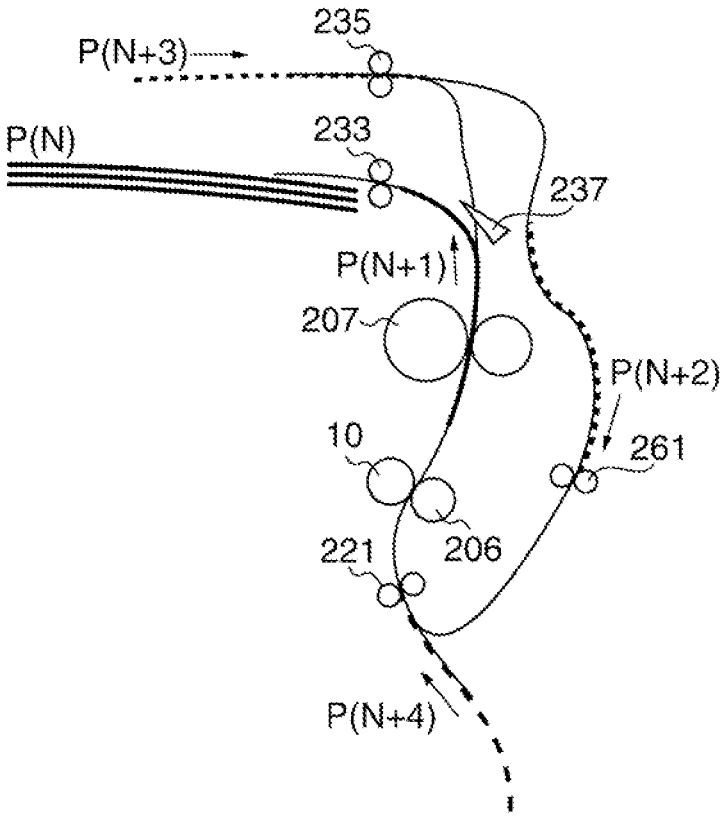
FIG. 4 is a view showing recording sheets on the conveyance path in the case of forming images on both sides of the recording sheets in the image forming apparatus shown in FIG. 1.

FIG. 4 is a view showing a plurality of recording sheets on the conveyance path in the case of forming images on both sides of the recording sheets.

As shown in FIG. 4, the recording sheet P(N) was ejected after forming images on both sides thereof. The recording sheet P(N+1) is passing through the fixing unit and will be ejected next to the recording sheet P(N).

The recording sheet P(N+2) waits at the position of the double-sided feed roller 261 for re-feeding. Since the image was formed on the back side of the recording sheet P(N+1), the next image will be formed on the front side thereof. Accordingly, the recording sheet P(N+4) that is supplied from the cassette in order to form an image on the front side is waiting at the position of the registration roller 221. It should be noted that the sequence of image formations on the recording sheets is as follows: a front side of sheet P(N), a back side of sheet P(N−2), a front side of sheet P(N+1), a back side of sheet P(N−1), a front side of sheet P(N+2), a back side of sheet P(N), a front side of sheet P(N+3), a back side of sheet P(N+1), a front side of sheet P(N+4), a back side of sheet P(N+2), and . . . . About several sheets of the beginning, an image is formed on the front side of sheet P(1), then, an image is formed on the front side of sheet P(2) at the interval of one sheet, and then, an image is formed on the front side of sheet P(3) at the interval of one sheet. After that, images will be sequentially formed on the back side of sheet P(1), the front side of sheet P(4), the back side of sheet P(2), the front side of sheet P(5), the back side of sheet P(3), and . . . . Moreover, if the number of recording sheets is M, about the last several sheets, images are formed on the front side of sheet P(M) and the back side of sheet P(M−2) continuously, then, an image is formed on the back side of sheet P(M−1) at the interval of one sheet, and then, an image is formed on the back side of sheet P(M) at the interval of one sheet.

As mentioned above, in the double-sided printing (double-sided image formation process), a predetermined number of recording sheets are continuously supplied from the cassette that is a recording sheet supply unit, and then, the re-feeding from the double-sided feed roller 261 and the feeding from the cassette are repeated alternately, and the predetermined number of recording sheets are continuously supplied from the double-sided feed roller 261 finally. The number of sheet that are continuously supplied from the cassette at beginning is beforehand set up according to the number of points at which a recording sheet after forming an image on the front side stops, the length of a recording sheet, and the length of the conveyance path. It should be noted that the feeding and the re-feeding of sheets in the double-sided printing are controlled by the CPU 171*c* as a control unit.

Figure 5:
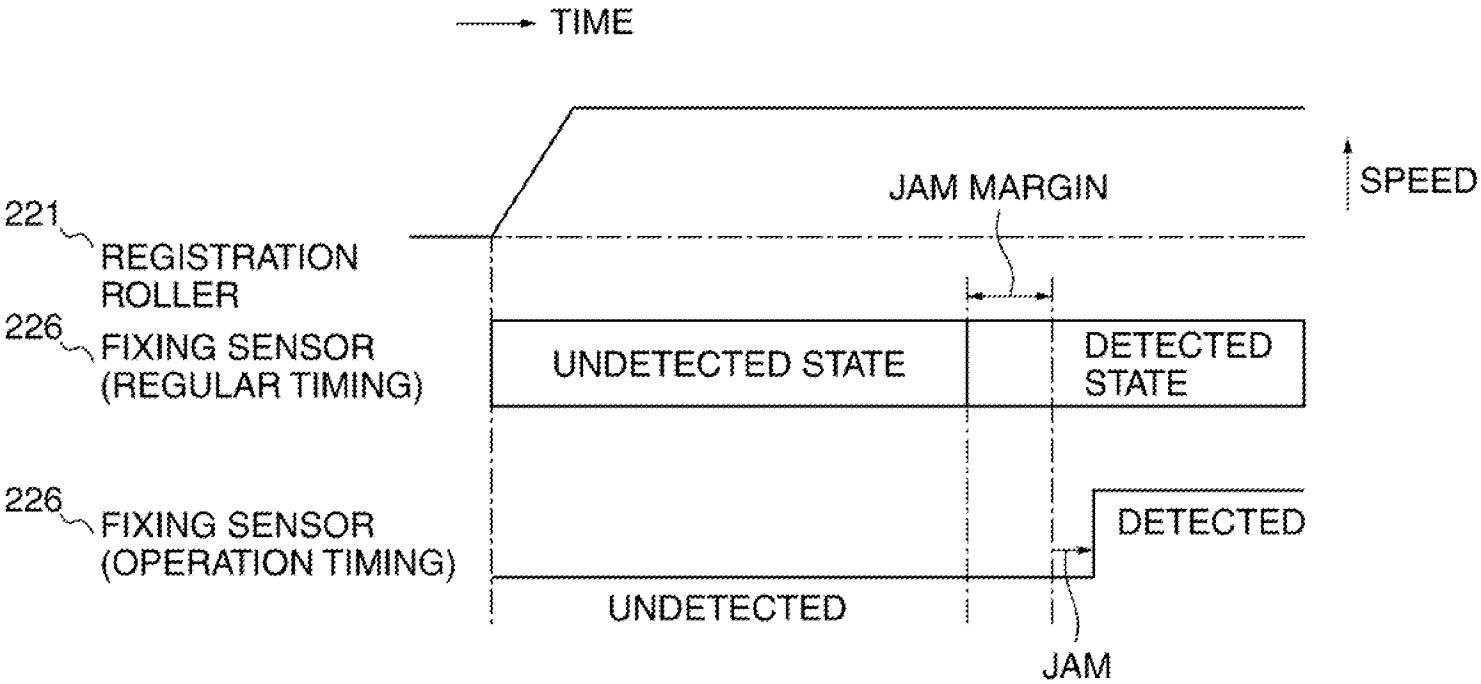
FIG. 5 is a sequential chart showing a jam detection process executed by the printer control unit shown in FIG. 2.

FIG. 5 is a sequential chart showing a jam detection process executed by the printer control unit 250 shown in FIG. 2. In the following description, a paper jam is only expressed as a jam.

The sequential chart shown in FIG. 5 shows driving timing of the registration roller 221 and a detection result of the fixing sensor 226.

The printer control unit 250 starts to monitor the output of the fixing sensor 226 since starting the motor to drive the registration roller 221. The regular timing when the recording sheet will arrive at the fixing sensor 226 that is calculated based on the predetermined distance between the registration roller 221 and the fixing sensors 226 and the conveyance speed of the recording sheet by the secondary transfer roller 206 is used as a reference. The detection timing of a recording sheet is verified based on the output of the fixing sensor 226 with reference to this regular timing.

FIG. 5 shows the case where conveyance of a recording sheet is delayed as an example. The recording sheet of which the front end passed the secondary transfer roller 206 is curved and reaches the fixing roller 207. When the sheet is curved too sharply, the recording sheet may reach the fixing sensor 226 with delay.

The jam margin shown in FIG. 5 represents a permissible range that can absorb the variation in the reaching timing due to delay (a range not to determine a jam). In this case, the jam is determined with reference to an operation timing that is determined based on the difference between the regular timing and the actual detection timing. In addition, for example, a recording sheet may jam at the entrance of the registration roller 221, the secondary transfer roller 206, or the fixing roller 207, and there may be conveyance abnormalities, such as a coiling-round jam in the fixing unit.

FIG. 6A through FIG. 6D are views showing example of jams occurred on the conveyance path.

It should be noted that a jamming sheet means a recording sheet that generates a jam and a residual sheet means a recording sheet that remains on the conveyance path except the jamming sheet. The CPU 171*c* manages the number of supplied recording sheets, and manages a position of each recording sheet and the number of ejected recording sheets by using various sheet sensors arranged on the conveyance path. Accordingly, the CPU 171*c* determines the numbers and positions of residual sheets. In addition, cross marks in FIG. 6A through FIG. 6D indicate the position at which the recording sheet jams.

In the following description, to make a plurality of copies of double-sided printed sheets of the same content is expressed as a continuous printing of the same content, and to make a plurality of copies of double-sided printed sheets of different contents is expressed as a continuous printing of different contents.

Figure 6A:
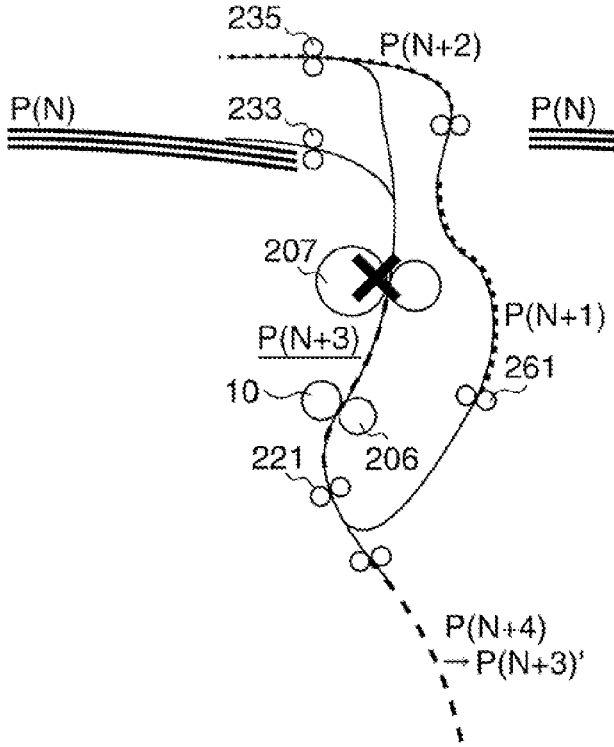
FIG. 6A through FIG. 6D are views showing examples of jams occurred on the conveyance path in the image forming apparatus shown in FIG. 1.

FIG. 6A shows a jamming example at the time of forming an image on a front side in the continuous printing of the same content.

Since the same content is continuously printed in the case shown in FIG. 6A, the same image is formed on the residual sheets P(N+1) and P(N+2) on the double-sided path. Accordingly, when the jamming sheet P(N+3) is removed, the image forming apparatus 30 can resume the process by using the sheet P(N+4) which did not reach the registration roller 221 as a sheet P(N+3)'.

Thus, if the jamming sheet P(N+3) is removed in the case in FIG. 6A, the image forming apparatus 30 can resume the process using the residual sheets as-is.

Figure 6B:
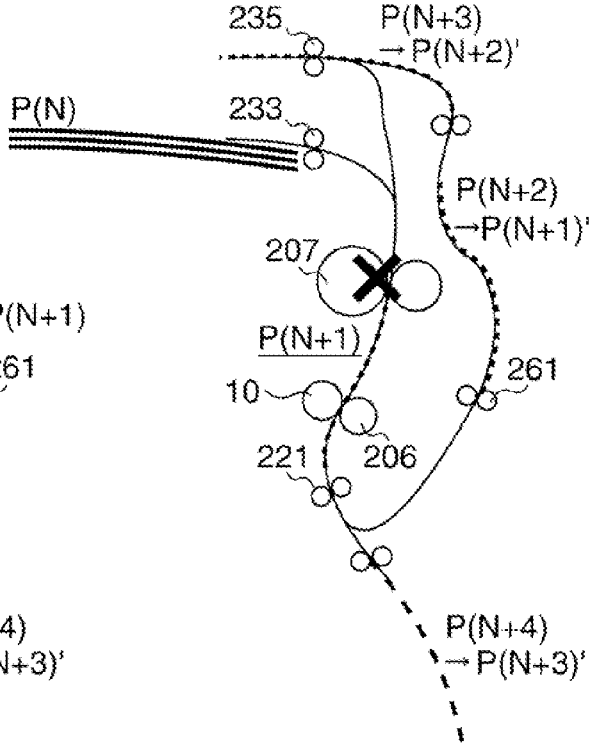

FIG. 6B shows a jamming example at the time of forming an image on a back side in the continuous printing of the same content.

Since the same content is continuously printed in the case shown in FIG. 6B, the same image is formed on the residual sheets P(N+2) and P(N+3) on the double-sided path. Accordingly, when the jamming sheet P(N+1) is removed, the image forming apparatus 30 can resume the process by using the sheets P(N+2) and P(N+3) as sheets P(N+1)' and P(N+2)' and by using the sheet P(N+4) which did not reach the registration roller 221 as a sheet P(N+3)'.

Thus, if the jamming sheet P(N+1) is removed in the case in FIG. 6B, the image forming apparatus 30 can resume the process using the residual sheets as-is.

Figure 6C:
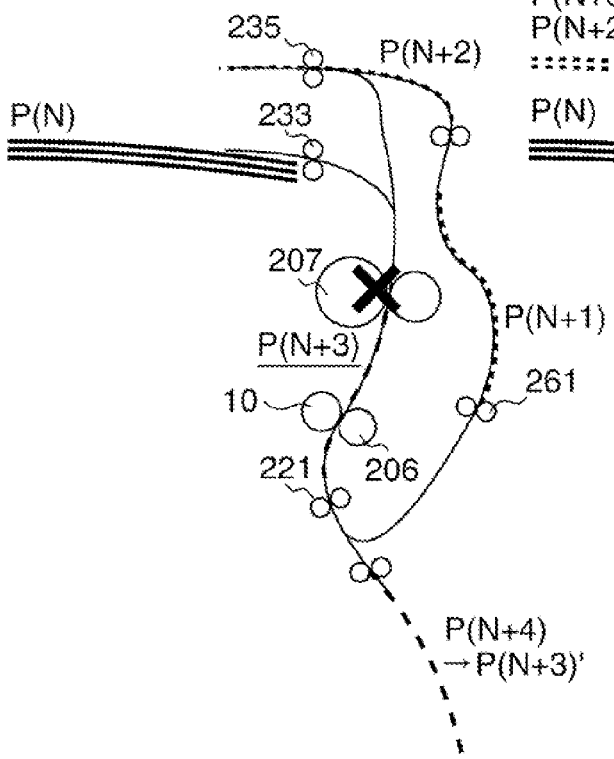

FIG. 6C shows a jamming example at the time of forming an image on a front side in the continuous printing of the different contents.

Since the recording sheet P(N+1) will be ejected next to the ejected recording sheet P(N) in the case shown in FIG. 6C, the sequence of the ejected recording sheets is maintained. Accordingly, if the jamming sheet P(N+3) is removed, the image forming apparatus 30 can resume the process by using the sheet P(N+4) as a sheet P(N+3)'.

Thus, if the jamming sheet P(N+3) is removed in the case in FIG. 6C, the image forming apparatus 30 can resume the process using the residual sheets as-is.

Figure 6D:
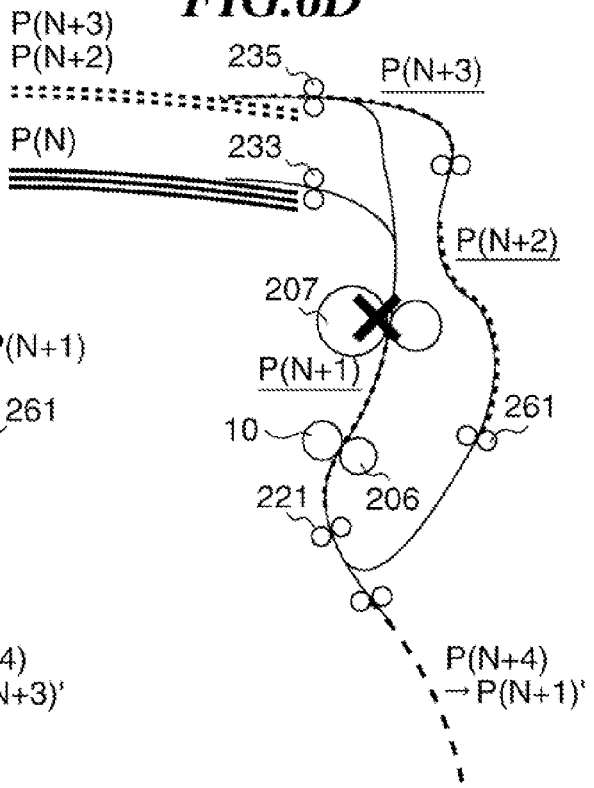

FIG. 6D shows a jamming example at the time of forming an image on a back side in the continuous printing of the different contents.

When the recording sheet P(N+2) is ejected next to the ejected recording sheet P(N) in the case shown in FIG. 6D, the recording sheet P(N+1) will be missing.

Even if the front side image that should be formed on the recording sheet P(N+1) is formed on the recording sheet P(N+4) that is newly supplied before the back side image is formed on the recording sheet P(N+2) on the double-sided path, the sequence of the ejected sheets cannot be maintained because the back side images are previously formed on the residual sheets P(N+2) and P(N+3) to which the front side images were formed.

Accordingly, the image forming apparatus 30 gives a user guidance so as to remove the recording sheet P(N+1). The image forming apparatus 30 automatically ejects the residual sheets P(N+2) and P(N+3) from the residual-sheet-ejection port 253 after the jam is removed, and resumes the process by using the recording sheet P(N+4) as a sheet P(N+1)'. In the automatic ejection at this time, the residual sheets P(N+2) and P(N+3) are ejected from the residual-sheet-ejection port 253 via the registration roller 221, the secondary transfer roller 206, the fixing roller 207, and the reversal roller 235. If the recording sheet P(N+3) has not reached the second ejection flapper 238 at the time of jam occurrence, the recording sheet P(N+3) may be automatically ejected from the direct residual sheet ejection port 253 without passing through the double-sided path 260.

Thus, if the jamming sheet P(N+1) is removed and the residual sheets P(N+2) and P(N+3) are automatically ejected in the case in FIG. 6D, the image forming apparatus 30 can resume the process using the other residual sheets as-is.

The above mentioned FIG. 6A through FIG. 6D show that a residual sheet to which no images are formed on both sides is determined available.

FIG. 6A and FIG. 6B show that all the residual sheets are determined available when a plurality of copies of the recording sheets to which the same double-sided images are formed are generated.

FIG. 6C shows that all the residual sheets are determined available when no image is formed on one side and an image is forming on the other side of the jamming sheet in the continuous printing of the different contents.

Then, FIG. 6D shows that a residual sheet other than a residual sheet to which no images are formed on both sides is determined unavailable when an image was formed on one side and an image is forming on the other side of the jamming sheet in the continuous printing of the different contents.

Figure 7:
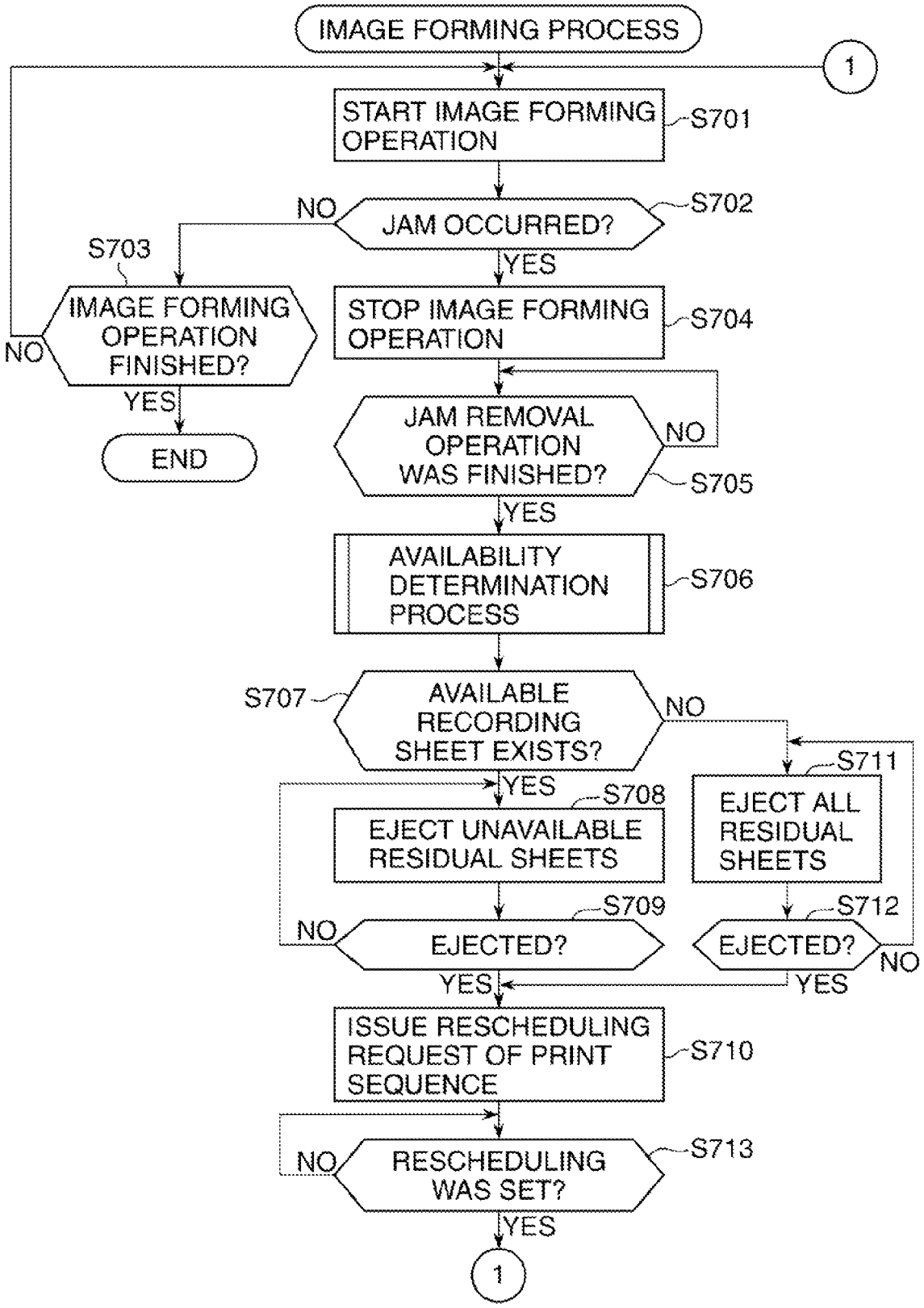
FIG. 7 is a flowchart showing an image forming process executed by the CPU in FIG. 2C.

FIG. 7 is a flowchart showing the image forming process executed by the CPU 171*c* in FIG. 2C.

In FIG. 7, the CPU 171*c* starts the image forming operation first (step S701). Next, the CPU 171*c* determines whether a jam occurred based on the output of the fixing sensor 226 (step S702). That is, the CPU 171*c* and the fixing sensor 226 correspond to the detection unit that detects a jam occurrence on the conveyance path along which the recording sheet supplied for forming an image is conveyed during the image forming process.

When a jam does not occur (NO in the step S702), the CPU 171*c* determines whether the image forming operation finished (step S703). When the image forming operation did not finish (NO in the step S703), the process returns to the step S701. On the other hand, when the image forming operation finished (YES in the step S703), the CPU 171*c* finishes this process.

When determining that a jam occurred (YES in the step S702), the CPU 171*c* stops the image forming operation (step S704). When the image forming operation stops, the recording sheets located in the downstream side of the jam occurrence point are controlled so as to be conveyed and ejected normally. That is, the CPU 171*c* corresponds to the control unit that stops the image forming process when detecting a jam occurrence.

After stopping the image forming operation, the CPU 171*c* instructs the user to remove the jam by removing the jamming sheet and the recording sheets that cannot be conveyed normally due to the jam through the operation unit 172 etc.

Next, when the jam removal operation is finished by the user (YES in the step S705), the CPU 171*c* executes an availability determination process that determines whether there is an available recording sheet among the residual sheets (step S706). When detecting opening and closing of a door using a door sensor (not shown), the CPU 171*c* determines that the jam was removed. That is, the CPU 171 corresponds to the determination unit that determines whether the residual sheets, which are recording sheets on the conveyance path other than the jamming sheet that generates the jam, are available in the image forming process resumed when the image forming process stops.

Then, the CPU 171*c* determines whether there is an available residual sheet based on the result of the availability determination process (step S707). When there is an available residual sheet (YES in the step S707), the CPU 171*c* ejects the unavailable residual sheets (step S708). The unavailable residual sheets are ejected from the residual-sheet-ejection port 253 via the registration roller 221, the secondary transfer roller 206, the fixing roller 207, and the reversal roller 235. If the recording sheet has not reached the second ejection flapper 238 at the time of jam occurrence, the recording sheet may be automatically ejected from the direct residual sheet ejection port 253 without passing through the double-sided path 260. That is, the registration roller 221, the secondary transfer roller 206, the fixing roller 207, the reversal roller 235, and the residual-sheet-ejection port 235 configure an ejection mechanism that ejects a residual sheet that is determined unavailable from the conveyance path.

Then, when the unavailable residual sheet was ejected (YES in the step S709), the CPU 171*c* issues a rescheduling request of the print sequence to the CPU 171*a* of the system control unit 100 (step S710). When the rescheduling was set in response to the rescheduling request (YES in the step S713), the process returns to the step S701, and the image forming operation will restart. That is, the CPU 171*c* corresponds to the control unit that resumes the stopped image forming process when the jamming sheet is removed and the residual sheet determined unavailable is ejected.

When the process resumes in the case of FIG. 6C, for example, the CPU 171*c* performs image formations to the residual sheets on the double-sided path first, ejects all the recording sheets on the conveyance path, and then, requests the rescheduling so as to perform image formations to sheets supplied from the cassette. Alternatively, the CPU 171*c* may request the rescheduling so as to form an image on the back side of the residual sheet on the double-sided path after forming an image on the front face of the recording sheet supplied from the cassette in the same manner as the normal image forming operation.

When there is no available residual sheet (NO in the step S707), the CPU 171*c* ejects all the residual sheets (step S711). Then, when all the residual sheets are ejected (YES in the step S712), the process proceeds to the step S710.

According to the process shown in FIG. 7, the image forming apparatus 30 stops the image forming process (the step S704) when detecting a jam occurrence (YES in the step S702). Then, the image forming apparatus 30 determines whether the residual sheets, which are recording sheets on the conveyance path other than the jamming sheet, are available in the image forming process resumed when the image forming process stops (the step S706). The image forming apparatus 30 ejects the residual sheets determined unavailable from the conveyance path (the step S708). Then, the image forming apparatus 30 resumes the stopped image forming process when the jamming sheet is removed and the residual sheet determined unavailable is ejected (the steps S713 and S701). Thereby, the image forming apparatus 30 that uses the residual sheet effectively is provided.

Figure 8:
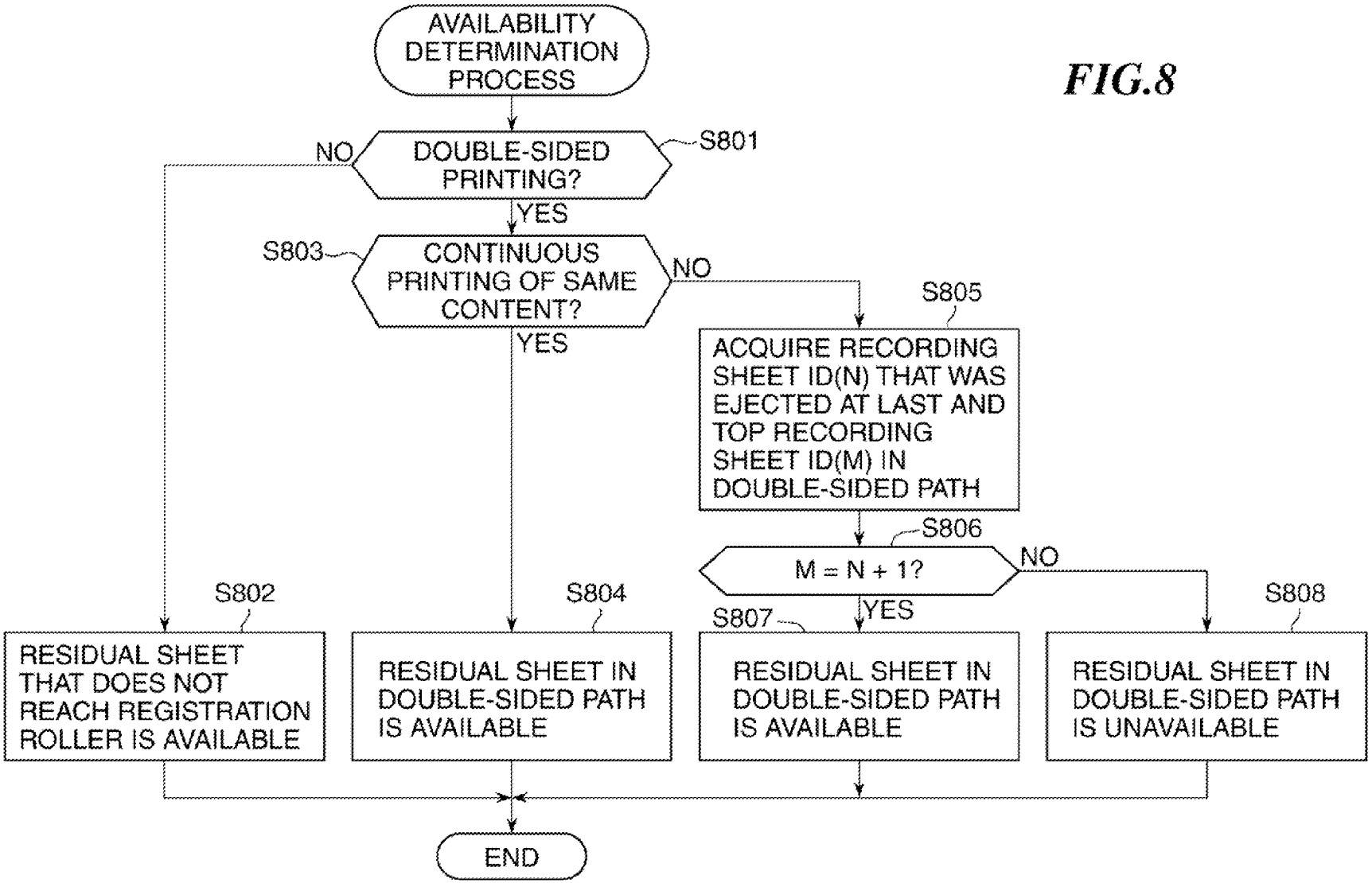
FIG. 8 is a flowchart showing the availability determination process in FIG. 7.

FIG. 8 is a flowchart showing the availability determination process in FIG. 7.

As shown in FIG. 8, the CPU 171*c* determines whether the set image forming process performs the image formation to both sides (step S801). When the image forming process performs the image formation to only one side (NO in the step S801), the CPU 171*c* determines that a residual sheet that does not reach the registration roller 221 is available (step S802), and finishes this process. This is because the recording sheet that was supplied from the cassette and does not reach the registration roller 221 is a blank sheet on which no image has been formed yet.

When the image forming process performs the image formation to both sides (YES in the step S801), the CPU 171*c* determines whether the image forming process set up is the continuous printing of the same content (step S803). When the image forming process is the continuous printing of the same content (YES in the step S803), the CPU 171*c* determines that the residual sheets on the double-sided path are available (step S804) and finishes this process. This is because the same image (the front side image) is formed on all the residual sheets on the double-sided path, and the back side image can be formed using the sheets as-is. It is determined that the residual sheets that have not reached the registration roller 221 are available.

When the image forming process is the continuous printing of the different contents (NO in the step S803), the CPU 171*c* acquires a sheet ID (N) of the latest recording sheet that was normally ejected and a sheet ID (M) of the top recording sheet on the double-sided path (step S805). It should be noted that M and N are natural numbers. A sheet ID is a number that is sequentially given to each recording sheet supplied in one print job. That is, if the sheet ID of a certain recording sheet is M, the sheet ID of the recording sheet supplied next will be M+1. The top recording sheet on the double-sided path is the top sheet among the sheets to which images are formed on one sides and no images are formed on the other sides.

Next, the CPU 171*c* determines whether the equation M=N+1 holds about M and N acquired (step S806). In this step S806, it is determined whether the top recording sheet on the double-sided path should be ejected next to the latest recording sheet that was ejected.

When the equation M=N+1 holds (YES in the step S806), the CPU 171*c* determines that the residual sheets on the double-sided path are available (step S807), and finishes this process. This is because the continuous images can be formed by forming back side images on the residual sheets on the double-sided path. It is determined that the residual sheets that have not reached the registration roller 221 are available.

When the equation M≠N+1 holds (NO in the step S806), the CPU 171*c* determines that the residual sheets on the double-sided path are unavailable (step S808), and finishes this process.

This is because an image next to the image formed on the latest recording sheet that was ejected cannot be formed by skipping the recording sheets on the double-sided path. It should be noted that a residual sheet that is located in the upstream side of the jamming sheet and that has reached registration roller 221 is determined unavailable in any steps S802, S804, S807, and S808.

Although the image forming apparatus with the vertical pass configuration in which the transfer position and the fixing position are vertically arranged is described as an example in the embodiment mentioned above, an image forming apparatus with a horizontal pass configuration in which the transfer position and the fixing position are horizontally arranged may be employed.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-107466, filed on May 9, 2012, which is hereby incorporated by reference herein in its entirety.

What is claimed is:

1. An image forming apparatus comprising:

a conveyance unit configured to convey a recording sheet along a conveyance path;

an image forming unit configured to form an image on the recording sheet conveyed by said conveyance unit;

a control unit configured to control said conveyance unit and said image forming unit so that a double-sided image formation process is performed to a plurality of recording sheets;

a detection unit configured to detect a jam of the recording sheet on the conveyance path; and a determination unit configured to determine whether residual sheets, which are recording sheets on the conveyance path other than a jamming sheet that generates a jam, are available in the double-sided image forming process resumed after the jam is removed when the jam is detected by said detection unit based on whether the same image is being formed on the plurality of recording sheets, an order identification number of a recording sheet on which an image has been formed on one side, and an order identification number of the latest recording sheet that was normally ejected, wherein said control unit stops the double-sided image formation process and ejects the residual sheets that are determined unavailable by said determination unit from the conveyance path.

2. The image forming apparatus according to claim 1, wherein said conveyance unit includes a first feeding unit that stores a plurality of recording sheets and supplies the stored recording sheets one-by-one to said image forming unit and a second feeding unit that supplies a recording sheet that was supplied from the first feeding unit and an image was formed on a first side thereof by said image forming unit to said image forming unit in order to form an image on a second side, and wherein image formations are continuously performed to first sides of a certain number of recording sheets supplied from the first feeding unit, then, an image formation to a second side of a recording sheet supplied from the second feeding unit and an image formation to a first side of a recording sheet supplied from the first feeding unit are alternately performed, and then, image formations are continuously performed to second sides of the certain number of recording sheets supplied from the second feeding unit in the double-sided image formation process.

3. The image forming apparatus according to claim 2, wherein said determination unit determines that a residual sheet to which an image is formed on one side and that has not reached the registration roller among the residual sheets is available when the double-sided image forming process is set to make a plurality of copies of double-sided printed sheets of the same content.

4. The image forming apparatus according to claim 2, wherein said conveyance unit has a registration roller that conveys the recording sheet to a transfer position at which a toner image is transferred to the recording sheet, and said determination unit determines that a residual sheet to which no images are formed on both sides and that has not reached the registration roller among the residual sheets is available.

5. The image forming apparatus according to claim 4, wherein said determination unit determines that the residual sheets to which images are formed on one sides and no images are formed on the other sides are available when the top sheet among the residual sheets to which images are formed on one sides and no images are formed on the other sides should be ejected next to the latest recording sheet that was normally ejected and when the double-sided image forming process is set to make a plurality of copies of double-sided printed sheets of different contents.

6. The image forming apparatus according to claim 5, wherein said determination unit determines that the residual sheets to which images are formed on one sides and no images are formed on the other sides are unavailable when the top sheet among the residual sheets to which images are formed on one sides and no images are formed on the other sides should not be ejected next to the latest recording sheet that was normally ejected and when the double-sided image forming process is set to make a plurality of copies of double-sided printed sheets of different contents.

7. The image forming apparatus according to claim 1, wherein said control unit controls to eject the residual sheets determined unavailable to a tray different from a tray to which a recording sheet is ejected normally.

8. The image forming apparatus according to claim 1, wherein said control unit controls said conveyance unit and said image forming unit so as to resume the double-sided image formation process when the residual sheets determined unavailable are ejected and when the jamming sheet is removed.

9. A control method for an image forming apparatus that performs a double-sided image formation process to a plurality of recording sheets, the control method comprising:

a detection step of detecting a jam of a recording sheet on a conveyance path;

a stopping step of stopping the double-sided image formation process when a jam is detected in said detection step;

a determination step of determining whether residual sheets, which are recording sheets on the conveyance path other than a jamming sheet that generates a jam, are available in the double-sided image forming process resumed after the jam is removed when the jam is detected in said detection step based on whether the same image is being formed on the plurality of recording sheets, an order identification number of a recording sheet on which an image has been formed on one side, and an order identification number of the latest recording sheet that was normally ejected; and an ejection step of ejecting the residual sheets determined unavailable in said determination step from the conveyance path.

10. The control method according to claim 9, wherein image formations are continuously performed to first sides of a certain number of recording sheets supplied from a first feeding unit, then, an image formation to a second side of a recording sheet supplied from a second feeding unit and an image formation to a first side of a recording sheet supplied from the first feeding unit are alternately performed, and then, image formations are continuously performed to second sides of the certain number of recording sheets supplied from the second feeding unit in the double-sided image formation process, and wherein the second feeding unit supplies a recording sheet on which an image was formed on a first side to an image forming unit in order to form an image on a second side.

11. The control method according to claim 9, wherein a residual sheet to which no images are formed on both sides and that has not reached a registration roller that conveys a recording sheet to a transfer position at which a toner image is transferred to the recording sheet among said residual sheets is determined available in said determination step.

12. The control method according to claim 11, wherein a residual sheet to which an image is formed on one side and that has not reached the registration roller among the residual sheets is determined available in said determination step when the double-sided image forming process is set to make a plurality of copies of double-sided printed sheets of the same content.

13. The control method according to claim 11, wherein the residual sheets to which images are formed on one sides and no images are formed on the other sides are determined available in said determination step when the top sheet among the residual sheets to which images are formed on one sides and no images are formed on the other sides should be ejected next to the latest recording sheet that was normally ejected and when the double-sided image forming process is set to make a plurality of copies of double-sided printed sheets of different contents.

14. The control method according to claim 13, wherein the residual sheets to which images are formed on one sides and no images are formed on the other sides are determined unavailable in said determination step when the top sheet among the residual sheets to which images are formed on one sides and no images are formed on the other sides should not be ejected next to the latest recording sheet that was normally ejected and when the double-sided image forming process is set to make a plurality of copies of double-sided printed sheets of different contents.

15. The control method according to claim 10, further comprising:

an ejection step of ejecting the residual sheets determined unavailable to a tray different from a tray to which a recording sheet is ejected normally.

16. The control method according to claim 10, further comprising:

a resuming step of resuming the double-sided image formation process when the residual sheets determined unavailable are ejected and when the jamming sheet is removed.

17. A non-transitory computer-readable storage medium storing a control program causing a computer to execute a control method for an image forming apparatus that performs a double-sided image formation process to a plurality of recording sheets, the control method comprising:

a detection step of detecting a jam of a recording sheet on a conveyance path;

a stopping step of stopping the double-sided image formation process when a jam is detected in said detection step;

a determination step of determining whether residual sheets, which are recording sheets on the conveyance path other than a jamming sheet that generates a jam, are available in the double-sided image forming process resumed after the jam is removed when the jam is detected in said detection step based on whether the same image is being formed on the plurality of recording sheets, an order identification number of a recording sheet on which an image has been formed on one side, and an order identification number of the latest recording sheet that was normally ejected; and an ejection step of ejecting the residual sheets determined unavailable in said determination step from the conveyance path.

* * * * *